US010890049B2

(12) United States Patent
Nichols

(10) Patent No.: US 10,890,049 B2
(45) Date of Patent: Jan. 12, 2021

(54) DOWNHOLE COMMUNICATION VALVE AND METHOD OF USE

(71) Applicant: COLT PETROLEUM TECHNOLOGY, LLC, Spring, TX (US)

(72) Inventor: Mark B. Nichols, Mineral Wells, TX (US)

(73) Assignee: COLT PETROLEUM TECHNOLOGY, LLC, The Woodlands, TX (US)

( * ) Notice: Subject to any disclaimer, the term of this patent is extended or adjusted under 35 U.S.C. 154(b) by 81 days.

(21) Appl. No.: 16/220,455

(22) Filed: Dec. 14, 2018

(65) Prior Publication Data

US 2019/0120015 A1 Apr. 25, 2019

Related U.S. Application Data

(63) Continuation of application No. 15/225,928, filed on Aug. 2, 2016, now Pat. No. 10,184,318.

(60) Provisional application No. 62/201,391, filed on Aug. 5, 2015.

(51) Int. Cl.
*E21B 34/14* (2006.01)
*E21B 34/10* (2006.01)

(52) U.S. Cl.
CPC ..... *E21B 34/10* (2013.01)

(58) Field of Classification Search
CPC .... E21B 34/085; E21B 34/102; E21B 34/108; E21B 34/125; E21B 34/12; E21B 2034/007
See application file for complete search history.

(56) References Cited

U.S. PATENT DOCUMENTS

| | | | | |
|---|---|---|---|---|
| 4,603,741 | A * | 8/1986 | Edgmon | E21B 34/14 166/317 |
| 5,865,254 | A | 2/1999 | Huber et al. | |
| 6,079,496 | A | 6/2000 | Hirth | |
| 6,742,595 | B2 | 6/2004 | Dennistoun et al. | |
| 7,681,665 | B2 | 3/2010 | Eppink | |
| 8,267,178 | B1 | 9/2012 | Sommers et al. | |
| 8,931,565 | B2 | 1/2015 | Desranleau et al. | |
| 9,121,252 | B2 * | 9/2015 | George | E21B 34/108 |
| 9,476,282 | B2 * | 10/2016 | Anton | E21B 34/063 |
| 9,670,750 | B2 | 6/2017 | Chauffe | |
| 10,184,318 | B2 * | 1/2019 | Nichols | E21B 34/10 |
| 2003/0024704 | A1 | 2/2003 | Hirsch et al. | |
| 2011/0308817 | A1 | 12/2011 | Ravensbergen | |
| 2013/0043032 | A1 | 2/2013 | Crowley et al. | |

FOREIGN PATENT DOCUMENTS

EP 1024245 A2 8/2000

OTHER PUBLICATIONS

International Search Report and Written Opinion dated Nov. 17, 2016 for Application No. PCT/US2016/045761.

* cited by examiner

*Primary Examiner* — Kenneth L Thompson
(74) *Attorney, Agent, or Firm* — Patterson + Sheridan, LLP

(57) ABSTRACT

A downhole communication valve containing a piston and chamber which allows hydrostatic testing of a casing or tubing string multiple times before permanently opening communication ports to the exterior.

14 Claims, 2 Drawing Sheets

DOWNHOLE COMMUNICATION VALVE AND METHOD OF USE

CROSS-REFERENCE TO RELATED APPLICATIONS

This application is a continuation application of U.S. patent application Ser. No. 15/225,928, filed Aug. 2, 2016, now U.S. Pat. No. 10,184,318, which claims benefit of U.S. Provisional Patent Application Ser. No. 62/201,391, filed Aug. 5, 2015, which are both herein incorporated by reference in their entirety.

FIELD OF THE INVENTION

The present invention generally relates to drilling and related equipment as typically used in the oil and gas industry. More specifically, the present invention relates to a valve that may be installed within a casing or tubing string and its method of use.

BACKGROUND OF THE INVENTION

A valve which provides flow ports between the internal and external portions that are selectively isolated until a successful integrity test of the casing or tubing string is completed. Hydrostatic pressure applied to the internal portion of the tool causes shifting of an internal piston which compresses gasses until a limit is reached which permanently opens the valve.

Said valve may be conversely used in any application in which hydrostatic pressure is the preferred or only available method of opening a valve.

DETAIL DESCRIPTIONS OF THE INVENTION

All illustrations of the drawings are for the purpose of describing selected versions of the present invention and are not intended to limit the scope of the present invention.

Figure 1:
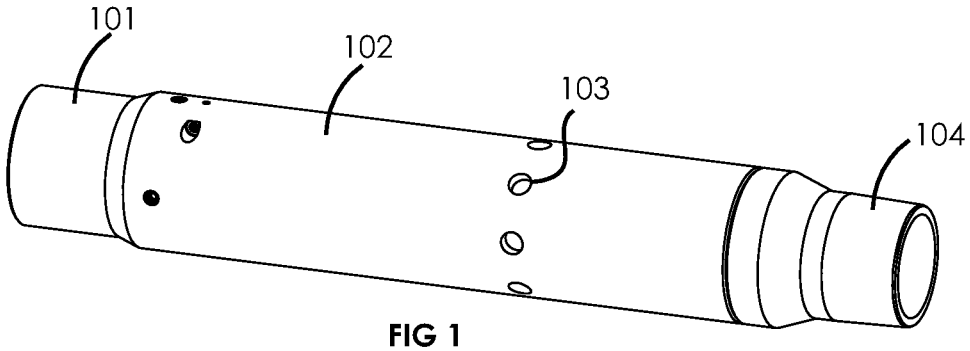
FIG. 1 is an elevated view of a multi-cycle communication valve in accordance with a preferred embodiment.
Figure 2:
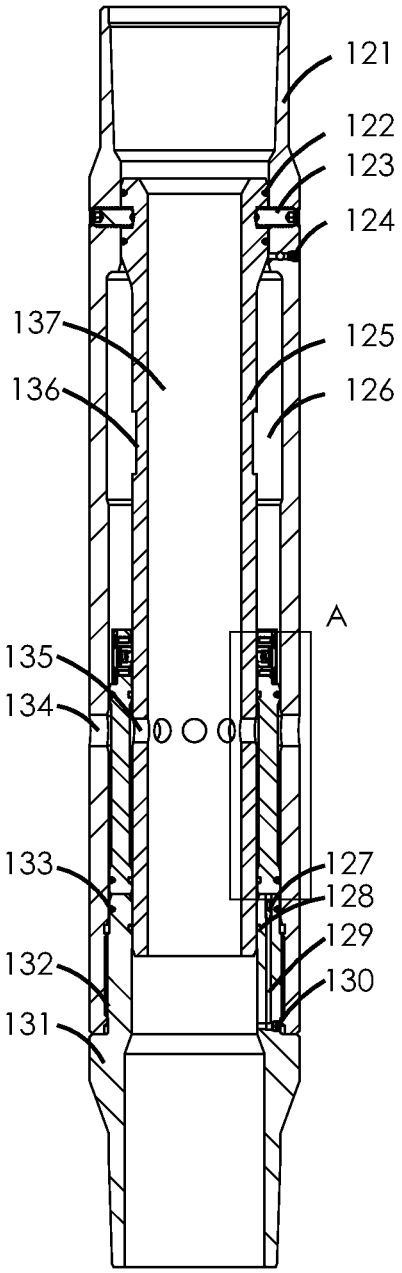
FIG. 2 is a section view of a closed multi-cycle communication valve in accordance with a preferred embodiment.
Figure 3:
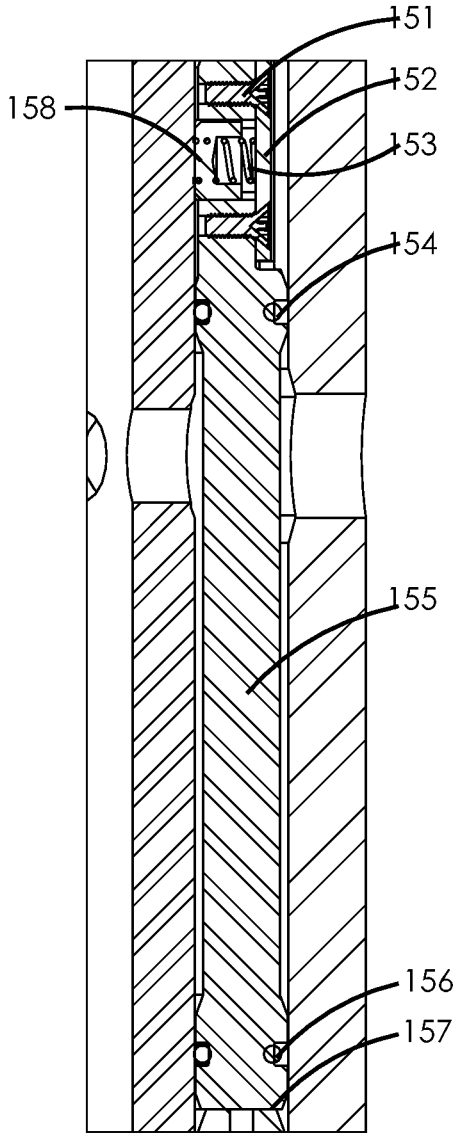
FIG. 3 is a detail view of the portion designated as "A" of FIG. 2.
Figure 6:
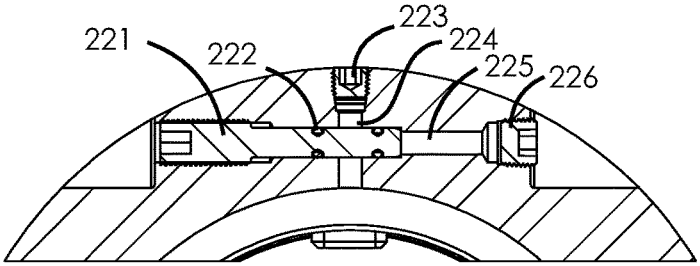
FIG. 6 is a detail view of a filling apparatus in the closed position as shown along the line "C-C" of FIG. 4.
Figure 7:
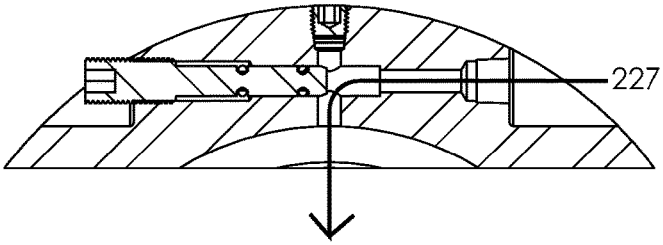
FIG. 7 is a detail view of a filling apparatus in the filling position as shown along the line "C-C" of FIG. 4.
Figure 4:
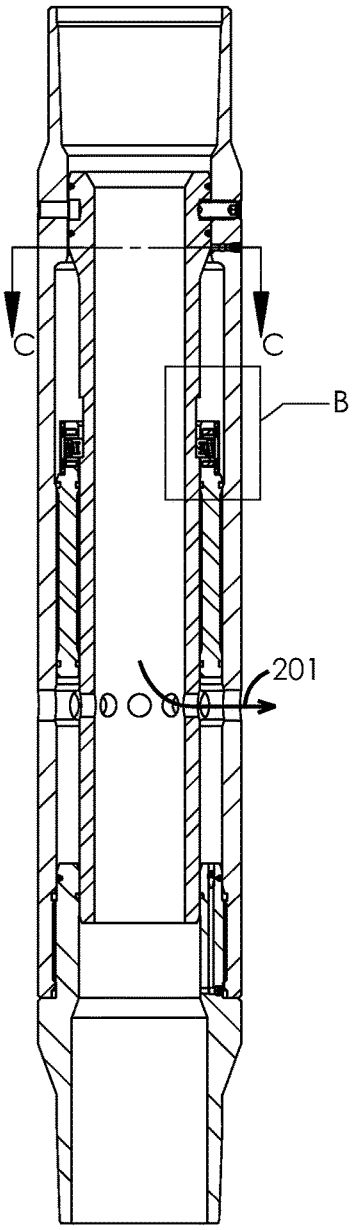
FIG. 4 is a section view of an opened and locked multi-cycle communication valve in accordance with a preferred embodiment.
Figure 5:
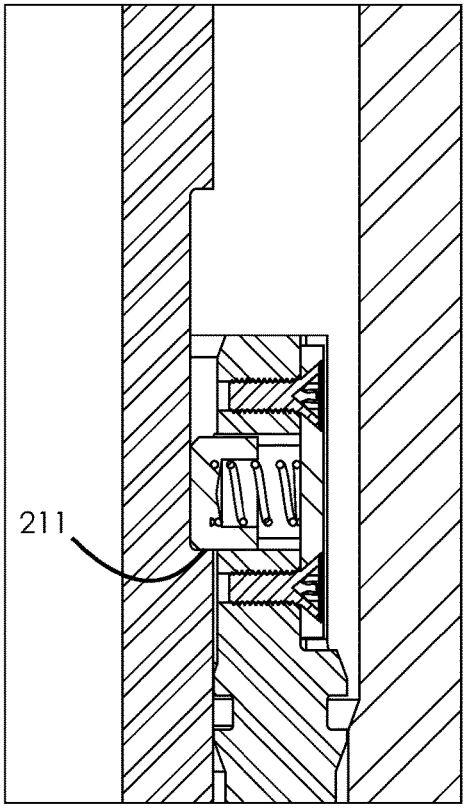
FIG. 5 is a detail view of the portion designated as "B" of FIG. 4.

Referring to FIGS. 1-7 there is provided a multi-cycle communication valve in accordance with a preferred embodiment. As used herein, the terms "a" or "an" shall mean one or more than one. The term "plurality" shall mean two or more than two. The term "another" is defined as a second or more. The terms "including" and/or "having" are open ended (e.g. comprising). The term "or" as used herein is to be interpreted as inclusive meaning one or any combination. Terms such as "upper" and "lower" are in reference to respective positions within the drawings and do not necessarily denote a physical configuration or orientation. Reference herein to "one embodiment", "certain embodiments", "an embodiment" or similar terms means that a particular feature or characteristic described in connection with the embodiment is included in at least one embodiment of the present disclosure. Thus the appearances of such phrases in various places throughout this specification are not necessarily all referring to the same embodiment. Furthermore, the particular features or characteristics may be combined in any suitable manner on one or more embodiments without limitation.

Generally in a preferred embodiment, the multi cycle communication valve is externally comprised of a housing 102, a lower sub 104 which preferably includes a threaded joint for connection to the lower portion of the casing or tubing string, a plurality of flow ports 103 which may be circular, slotted or of any shape to provide adequate flow area and a means of connection to upper portion of the casing or tubing string 101. The multi-cycle communication valve selectively permits fluid transfer to occur between the interior and exterior via the ports 103.

A mandrel 125 is preferably disposed within the bore of the housing 121. Said mandrel may be secured in place with a plurality of screws 123 or by any other acceptable means such as a locking shoulder or a threaded joint. The mandrel preferably provides a bore 137 for the transmission of fluids through the interior to lower portions of the casing or tubing string. The mandrel also preferably provides a plurality of ports 135 which may selectively provide communication between the mandrel's bore 137 and the exterior of the valve via ports provided in the housing 134.

A sleeve 155 is preferentially disposed within the annulus between the mandrel and the housing 121. Upper sleeve seals 154 and mandrel seals 122 create a chamber 126 which may be pre-filled with a gas or liquid via a filling apparatus 124.

An end sub 131 is preferably secured to the housing 121 via a threaded connection 132 thus further restraining the interior components.

Said sleeve 155 may provide a locking feature which is preferably comprised by a plurality of keys 158, springs 153, plates 152 and screws 151. Said spring 153 preferentially is compressed inward by said springs 153. Said spring 153 is kept in compression by the installation of a said cover plate 152 and screws 151. The surface of the mandrel does not allow extension until said key is aligned with a groove in the mandrel 136 thus allowing locking up the keys against a shoulder 211.

The aforementioned filling apparatus 124 may be more generally comprised of intersecting holes 224 and 225, a straight plug 221 with seals 222, a semi-permanent plug 223 and another plug 226. In one configuration, the straight plug 221 is partially withdrawn. Gas or liquid may be filled into the aforementioned chamber 126 via the open passageway 227. Once filling has completed, the straight plug 221 may be inserted such that the seals 222 stop flow from the chamber 126 to the exterior. The plug 226 may be subsequently installed for redundancy.

It will be obvious to one skilled in the art that many such filling arrangements could be used. An alternative is a simple check valve.

Once the chamber 126 is filled to a pre-determined pressure, the sleeve 155 will be forced in the closed direction unless the pressure acting on the sleeve's lower face 157 exceeds the pressure in the chamber 126. If the pressure on the lower face 157 exceeds the pressure in the chamber 126, the sleeve will begin to traverse away from the end sub 131.

A second chamber will be formed by the movement of the sleeve 155. This chamber is defined as the annulus between the mandrel 125 and housing 121 longitudinally constrained between the sleeve 151 and the end sub 131. The chamber is isolated by the end sub seals 133 and 128 and the lower sleeve seals 155. Flow of fluids is permitted into this void or chamber via a series of holes 129. Said holes may be intersecting for manufacturability in which case one or more may be sealed with a plug 130. Flow through these holes is restricted or metered by an insert or orifice 127. The metering of flow controls the speed of the traverse rate of the sleeve 155.

In use, a preferred embodiment of the valve is first assembled and then pre-filled with air or nitrogen as previously described. This pressure may depend on many factors such as well conditions, desired delay time, etc. The valve is then run into the well. To perform a pressure integrity test, pressure on the interior of the casing may be raised to an identified target. This pressure may be held for a period of time before the valve opens. If for any reason, the test is desired to be terminated, the valve may be returned to its original configuration if it has not been fully locked. Therefore, testing may be performed multiple times if desired.

When it is desired to permanently open the valve, a pressure is applied to the interior of the casing or tubing. This pressure is identified by a variety of means but is typically less than the previously mentioned test pressure. If this pressure is held for a sufficient period of time, the valve will first open where the sleeve 155 traverses such that the mandrel ports 135 and the housing ports 134 allow communication with the exterior. The sleeve may then be closed if pressure is relieved or if pressure is maintained, the valve may be placed in the locked position as previously described. If placed in the locked position, the sleeve will permanently allow communication between the ports and thus between the exterior and the interior.

Although the invention has been explained in relation to its preferred embodiment, it is to be understood that many other possible modifications and variations can be made without departing from the spirit and scope of the invention.

I claim:

1. A downhole valve comprising:

a tubular housing;

a tubular mandrel disposed radially inward of the tubular housing and partially defining an annular volume therebetween;

a tubular sleeve movably disposed within the annular volume and having a first end and a second end;

a sealed chamber within the annular volume and adjacent to the first end of the tubular sleeve; and a passageway adjacent to the second end of the tubular sleeve and selectively fluidly coupling the annular volume with a central bore, wherein the tubular sleeve is movable between a closed position and a test position when a pressure in the central bore is less than a pre-determined pressure of the sealed chamber, and the tubular sleeve is movable to an open, locked position upon a pressure in the central bore reaching a pre-determined pressure that exceeds a pressure of the sealed chamber, and wherein the closed position restricts communication between the central bore and an exterior of the valve, the test position selectively permits communication between the central bore and the exterior of the valve, and the open, locked position permanently permits communication between the central bore and the exterior of the valve.

2. The downhole valve of claim 1, wherein the sealed chamber is filled with a compressible fluid.

3. The downhole valve of claim 1, wherein movement of the tubular sleeve to the open, locked position forms a second chamber within the annular volume adjacent to the second end of the tubular sleeve.

4. The downhole valve of claim 1, wherein the passageway further comprises an orifice or restrictor to control a flow rate of fluid into the annular volume.

5. The downhole valve of claim 1, wherein the tubular sleeve is reversibly movable in either direction between the closed position and the test position.

6. The downhole valve of claim 1, wherein the tubular mandrel comprises a first plurality of ports disposed therethrough and extending between the central bore and the annular volume.

7. The downhole valve of claim 6, wherein the tubular housing comprises a secondary plurality of ports disposed therethrough and extending between the annular volume and an exterior of the valve.

8. The downhole valve of claim 7, wherein the first and second pluralities of ports are in permanent fluid communication with each other when the tubular sleeve is in the open, locked position.

9. A downhole valve comprising:

a tubular housing;

a tubular mandrel disposed radially inward of the tubular housing and partially defining an annular volume therebetween;

a tubular sleeve movably disposed within the annular volume and having a first end and a second end;

a sealed chamber within the annular volume and adjacent to the first end of the sleeve;

a passageway adjacent to the second end of the tubular sleeve and selectively fluidly coupling the annular volume with a central bore; and a locking apparatus to secure the tubular sleeve in an open, locked position, the locking apparatus comprising a spring-loaded key, wherein the tubular sleeve is reversibly movable between a closed position and a test position until a pressure in the central bore reaches a pre-determined pressure that exceeds a pressure of the sealed chamber, and the tubular sleeve is movable to the open, locked position upon the pressure in the central bore reaching the pre-determined pressure, and wherein the closed position restricts communication between the central bore and an exterior of the valve, the test position selectively permits communication between the central bore and the exterior of the valve, and the open, locked position permanently permits communication between the central bore and the exterior of the valve.

10. The downhole valve of claim 9, wherein fluid communication is not permitted between the central bore and an exterior of the valve when the tubular sleeve is in the closed position.

11. The downhole valve of claim 9, wherein fluid communication is permitted between the central bore and an exterior of the valve when the tubular sleeve is in the open, locked position.

12. The downhole valve of claim 9, wherein a direction of movement of the tubular sleeve is determined by a pressure differential between the first end and the second end of the tubular sleeve.

13. A downhole valve comprising:

a tubular housing;

a mandrel disposed radially inward of the tubular housing and partially defining an annular volume therebetween, the mandrel further defining a central volume therein;

a sleeve movably disposed within the annular volume, the sleeve movable between:

a first position wherein fluid communication is not permitted between between the central volume and an exterior of the valve; and a second position wherein fluid communication is permitted between the central volume and the exterior of the valve;

a sealed chamber within the annular volume and adjacent to a first end of the sleeve; and one or more orifices adjacent to a second end of the sleeve and in selective fluid communication with the central volume and the annular volume, wherein the sleeve is movable to the second position upon a pressure in the central volume reaching a pre-determined pressure greater than a pressure of the sealed chamber and, wherein the sleeve is reversibly movable between the first position and a third position when the pressure in the central volume is less than the pre-determined pressure.

14. The downhole valve of claim 13, wherein a direction of movement of the sleeve within the annular volume is determined by a pressure differential between the first end of the sleeve and a second end of the sleeve.

* * * * *